US009636812B2

(12) United States Patent
Pedicini

(10) Patent No.: US 9,636,812 B2
(45) Date of Patent: May 2, 2017

(54) FASTENER DRIVING APPARATUS

(71) Applicant: Christopher Pedicini, Nashville, TN (US)

(72) Inventor: Christopher Pedicini, Nashville, TN (US)

(73) Assignee: Tricord Solutions, Inc., Franklin, TN (US)

( * ) Notice: Subject to any disclaimer, the term of this patent is extended or adjusted under 35 U.S.C. 154(b) by 0 days.

(21) Appl. No.: 14/750,136

(22) Filed: Jun. 25, 2015

(65) Prior Publication Data

US 2016/0214248 A1 Jul. 28, 2016

Related U.S. Application Data

(60) Provisional application No. 62/106,770, filed on Jan. 23, 2015.

(51) Int. Cl.
*B25C 1/04* (2006.01)
*B25C 1/06* (2006.01)

(52) U.S. Cl.
CPC ..... *B25C 1/041* (2013.01); *B25C 1/047* (2013.01)

(58) Field of Classification Search
CPC .... B25C 1/04; B25C 1/06; B25C 5/13; B25C 5/15
USPC ..... 227/8, 10, 130
See application file for complete search history.

(56) References Cited

U.S. PATENT DOCUMENTS 3,810,572 A * 5/1974 Malkin ..... B25C 1/06 227/131
4,215,808 A 8/1980 Sollberger et al.
4,717,060 A * 1/1988 Cotta ..... B25C 1/08 227/10
4,932,479 A 6/1990 Pyatov
5,720,423 A 2/1998 Kondo et al.
5,794,325 A * 8/1998 Fallandy ..... B25D 11/108 173/203
6,938,811 B2 * 9/2005 Ehmig ..... B25C 1/14 227/10
6,997,367 B2 * 2/2006 Hu ..... B25C 5/15 173/202
7,063,247 B1 * 6/2006 Lund ..... A01D 34/82 123/286

(Continued)

FOREIGN PATENT DOCUMENTS

WO WO2015143762 10/2015

*Primary Examiner* — Gloria R Weeks
(74) *Attorney, Agent, or Firm* — Jay Schloff; Aidenbaum Schloff and Bloom PLLC

(57) ABSTRACT

A fastener driving apparatus includes a drive mechanism, a drive piston disposed with in a cylinder and operatively coupled to the drive mechanism, and an anvil coupled to the drive piston. The apparatus also preferably comprises a biasing element for temporarily holding the drive piston at BDC of the piston cylinder. The drive mechanism is capable of selectively applying force on the drive piston to move the drive piston away from BDC of the piston cylinder. When the drive mechanism engages the drive piston to move the drive piston away from BDC, a vacuum is generated in the cylinder, which vacuum, after the drive mechanism disengages the drive piston, acts on the drive piston to cause the piston to move toward BDC and the anvil to drive a fastener. A sealed air chamber on the side of the piston opposite the vacuum may assist in generating force.

20 Claims, 7 Drawing Sheets

(56) References Cited

U.S. PATENT DOCUMENTS

| | | | | |
|---|---|---|---|---|
| 7,520,414 | B2 * | 4/2009 | Blessing | B25C 1/06 173/117 |
| 7,757,922 | B2 * | 7/2010 | Wang | B25C 1/06 227/110 |
| 7,922,059 | B2 * | 4/2011 | Schiestl | B25C 1/06 162/158 |
| 7,938,305 | B2 * | 5/2011 | Simonelli | B25C 1/06 227/129 |
| 7,980,440 | B2 * | 7/2011 | Hahn | B25C 1/08 123/46 SC |
| 7,992,756 | B2 * | 8/2011 | Franz | B25C 1/06 227/131 |
| 8,011,547 | B2 * | 9/2011 | Leimbach | B25C 1/047 227/129 |
| 8,079,504 | B1 | 12/2011 | Pedicini et al. | |
| 8,267,297 | B2 * | 9/2012 | Leimbach | B25C 1/047 227/130 |
| 8,602,282 | B2 | 12/2013 | Leimbach et al. | |
| 8,733,610 | B2 * | 5/2014 | Pedicini | B25C 5/15 173/201 |
| 8,939,341 | B2 * | 1/2015 | Pedicini | B25C 1/06 173/201 |
| 2004/0232191 | A1 * | 11/2004 | Schiestl | B25C 1/08 227/10 |
| 2007/0045377 | A1 * | 3/2007 | Towfighi | B25C 1/06 227/130 |
| 2007/0138230 | A1 * | 6/2007 | Gschwend | B25C 1/08 227/10 |
| 2014/0374461 | A1 * | 12/2014 | Pedicini | B25C 1/06 227/2 |
| 2016/0096259 | A1 * | 4/2016 | Pedicini | B25C 1/047 227/146 |

* cited by examiner

FASTENER DRIVING APPARATUS

CROSS-REFERENCE TO RELATED APPLICATIONS

The present disclosure claims priority under 35 U.S.C. §119 on pending U.S. Provisional Application Ser. No. 62/106,770, filed on Jan. 23, 2015, the disclosure of which is incorporated by reference.

FIELD OF THE DISCLOSURE

The present disclosure relates to fastener driving apparatuses, and, more particularly, to such fastener or staple driving mechanisms that require operation as a hand tool.

BACKGROUND

Electromechanical fastener driving apparatuses (also referred to herein as a "driver," "gun" or "device") known in the art often weigh generally less than 15 pounds and may be configured for an entirely portable operation. Contractors and homeowners commonly use power-assisted devices and means of driving fasteners into wood. These power-assisted means of driving fasteners can be either in the form of finishing fastener systems used in baseboards or crown molding in house and household projects, or in the form of common fastener systems that are used to make walls or hang sheathing onto same. These systems can be portable (i.e., not connected or tethered to an air compressor or wall outlet) or non-portable.

The most common fastener driving apparatus uses a source of compressed air to actuate a guide assembly to push a fastener into a substrate. For applications in which portability is not required, this is a very functional system and allows rapid delivery of fasteners for quick assembly. A disadvantage is that it does however require that the user purchase an air compressor and associated air-lines in order to use this system. A further disadvantage is the inconvenience of the device being tethered (through an air hose) to an air compressor.

To solve this problem, several types of portable fastener drivers operate off of fuel cells. Typically, these guns have a guide assembly in which a fuel is introduced along with oxygen from the air. The subsequent mixture is ignited with the resulting expansion of gases pushing the guide assembly and thus driving the fastener into the workpieces. This design is complicated and is far more expensive then a standard pneumatic fastener gun. Both electricity and fuel are required as the spark source derives its energy typically from batteries. The chambering of an explosive mixture of fuel, the use of consumable fuel cartridges, the loud report and the release of combustion products are all disadvantages of this solution. Systems such as these are already in existence and are sold commercially to contractors under the Paslode™ name.

Another commercially available solution is a fastener gun that uses electrical energy to drive a stapler or wire brad. Such units typically use a solenoid to drive the fastener (such as those commercially available under the Arrow™ name or those which use a ratcheting spring system such as the Ryobi™ electric stapler). These units are limited to short fasteners (typically 1" or less), are subject to high reactionary forces on the user and are limited in their repetition rate. The high reactionary force is a consequence of the comparatively long time it takes to drive the fastener into the substrate. Additionally, because of the use of mechanical springs or solenoids, the ability to drive longer fasteners or larger fasteners is severely restricted, thus relegating these devices to a limited range of applications. A further disadvantage of the solenoid driven units is they often must be plugged into the wall in order to have enough voltage to create the force needed to drive even short fasteners.

A final commercially available solution is to use a flywheel mechanism and clutch the flywheel to an anvil that drives the fastener. Examples of such tools can be found under the Dewalt™ name. This tool is capable of driving the fasteners very quickly and in the longer sizes. The primary drawback to such a tool is the large weight and size as compared to the pneumatic counterpart. Additionally, the drive mechanism is very complicated, which gives a high retail cost in comparison to the pneumatic fastener gun.

Clearly based on the above efforts, a need exists to provide portable solution to driving fasteners which is unencumbered by fuel cells or air hoses. Additionally, the solution ought to provide a low reactionary feel, be able to drive full size fasteners and be simple, cost effective and robust in operation.

The prior art teaches several additional ways of driving a fastener or staple. The first technique is based on a multiple impact design. In this design, a motor or other power source is connected to an impact anvil through either a lost motion coupling or other device. This allows the power source to make multiple impacts on the fastener to drive it into the workpiece. The disadvantages in this design include increased operator fatigue since the actuation technique is a series of blows rather than a single drive motion. A further disadvantage is that this technique requires the use of an energy absorbing mechanism once the fastener is seated. This is needed to prevent the anvil from causing excessive damage to the substrate as it seats the fastener. Additionally, the multiple impact designs are not very efficient because of the constant motion reversal and the limited operator production speed.

A second design that is taught in U.S. Pat. Nos. 3,589,588, 5,503,319, and 3,172,121 includes the use of potential energy storage mechanisms (in the form of a mechanical spring). In these designs, the spring is cocked (or activated) through an electric motor. Once the spring is sufficiently compressed, the energy is released from the spring into the anvil (or fastener driving piece), thus pushing the fastener into the substrate. Several drawbacks exist to this design. These include the need for a complex system of compressing and controlling the spring, and in order to store sufficient energy, the spring must be very heavy and bulky. Additionally, the spring suffers from fatigue, which gives the tool a very short life. Finally, metal springs must move a significant amount of mass in order to decompress, and the result is that these low-speed fastener drivers result in a high reactionary force on the user.

To improve upon this design, an air spring has been used to replace the mechanical spring. U.S. Pat. No. 4,215,808 teaches of compressing air within a guide assembly and then releasing the compressed air by use of a gear drive. This patent overcomes some of the problems associated with the mechanical spring driven fasteners described above, but is subject to other limitations. One particular troublesome issue with this design is the safety hazard in the event that the anvil jams on the downward stroke. If the fastener jams or buckles within the feeder and the operator tries to clear the jam, he is subject to the full force of the anvil, since the anvil is predisposed to the down position in all of these types of devices. A further disadvantage presented is that the fastener must be fed once the anvil clears the fastener on the backward stroke. The amount of time to feed the fastener is limited and can result in jams and poor operation, especially with longer fasteners. A further disadvantage to the air spring results from the need to have the ratcheting mechanism as part of the anvil drive. This mechanism adds weight and causes significant problems in controlling the fastener drive since the weight must be stopped at the end of the stroke. This added mass slows the fastener drive stroke and increases the reactionary force on the operator. Additionally, because significant kinetic energy is contained within the air spring and piston assembly the unit suffers from poor efficiency. This design is further subject to a complicated drive system for coupling and uncoupling the air spring and ratchet from the drive train which increases the production cost and reduces the system reliability.

U.S. Pat. No. 5,720,423 again teaches of an air spring that is compressed and then released to drive the fastener. The drive or compression mechanism used in this device is limited in stroke and thus is limited in the amount of energy which can be stored into the air stream. In order to provide sufficient energy in the air stream to achieve good performance, this patent teaches use of a gas supply which preloads the guide assembly at a pressure higher than atmospheric pressure. Furthermore, the compression mechanism is bulky and complicated. In addition, the timing of the motor is complicated by the small amount of time between the release of the piston and anvil assembly from the drive mechanism and its subsequent re-engagement. Additionally, U.S. Pat. No. 5,720,423 teaches that the anvil begins in the retracted position, which further complicates and increases the size of the drive mechanism. Furthermore, because of the method of activation, these types of mechanisms as described in U.S. Pat. Nos. 5,720,423 and 4,215,808 must compress the air to full energy and then release off the tip of the gear while under full load. This method of compression and release causes severe mechanism wear. As will be discussed below, the present disclosure overcomes these and other limitations in the prior art use of air springs.

A third means for driving a fastener that is taught includes the use of flywheels as energy storage means. The flywheels are used to launch a hammering anvil that impacts the fastener. This design is described in detail in U.S. Pat. Nos. 4,042,036, 5,511,715, and 5,320,270. One major drawback to this design is the problem of coupling the flywheel to the driving anvil. This prior art teaches the use of a friction clutching mechanism that is both complicated, heavy and subject to wear. Further limiting this approach is the difficulty in controlling the energy in the fastener system. The mechanism requires enough energy to drive the fastener, but retains significant energy in the flywheel after the drive is complete. This further increases the design complexity and size of such prior art devices.

A fourth means for driving a fastener is taught in U.S. Pat. No. 8,079,504, which uses a compression on demand system with a magnetic detent. This system overcomes many of the advantages of the previous systems but still has its own set of disadvantages which include the need to retain a very high pressure for a short period of time and the use of two pistons. This pressure and subsequent force necessitate the use of high strength components and more expensive batteries and motors.

A fifth means is taught in U.S. Pat. No. 8,773,610, which uses a vacuum to drive a fastener drive assembly. This clearly has its own advantages over the previous systems but has its own set of disadvantages, including the need to retain a seal against air pressure. This sealing requirement and multiple piston configuration necessitates the use of more components and more accurate cylinders and pistons, thus contributing to the manufacturing cost.

All of the currently available devices suffer from one or more the following disadvantages:

- Complex, expensive and unreliable designs. Fuel powered mechanisms such as Paslode™ achieve portability but require consumable fuels and are expensive. Rotating flywheel designs such as Dewalt™ have complicated coupling or clutching mechanisms based on frictional means. This adds to their expense.
- Poor ergonomics. The fuel powered mechanisms have loud combustion reports and combustion fumes. The multiple impact devices are fatiguing and are noisy.
- Non-portability. Traditional fastener guns are tethered to a fixed compressor and thus must maintain a separate supply line.
- High reaction force and short life. Mechanical spring driven mechanisms have high tool reaction forces because of their long fastener drive times. Additionally, the springs are not rated for these types of duty cycles leading to premature failure. Furthermore, consumers are unhappy with their inability seat longer fasteners or work with denser wood species.
- Safety issues. The prior art "air spring" and heavy spring driven designs suffer from safety issues for longer fasteners since the predisposition of the anvil is towards the substrate. During jam clearing, this can cause the anvil to strike the operators hand.
- The return mechanisms in most of these devices involve taking some of the drive energy. Either there is a bungee or spring return of the driving anvil assembly or there is a vacuum or air pressure spring formed during the movement of the anvil. All of these mechanisms take energy away from the drive stroke and decrease efficiency.

In light of these various disadvantages, there exists the need for a fastener driving apparatus that overcomes these various disadvantages of the prior art, while still retaining the benefits of the prior art.

SUMMARY OF THE INVENTION

In accordance with the present invention, a fastener driving apparatus is described which derives its power from an electrical source, preferably rechargeable batteries, and uses a drive mechanism and motor to actuate a drive piston that is disposed within a cylinder. In an embodiment, the operational cycle commences with the drive piston at the bottom dead center (BDC) position in the cylinder. The drive mechanism causes the drive piston to move away from BDC to create or increase a vacuum between the drive piston and the bottom of the cylinder. The drive mechanism may thereafter cease acting (or imparting a force) on the drive piston and allow the vacuum to act on the drive piston such that the drive piston returns to BDC. The drive piston includes or is operatively coupled to an anvil such that when the vacuum acts on the drive piston to return the piston to the BDC position to drive a fastener that is disposed in proximity to the drive piston. A check valve or other venting mechanism may be provided to release any air that may have leaked into the vacuum area. A biasing element (such as a spring or elastomer, for example) may be provided for holding the drive piston at the BDC position until the drive mechanism acts upon the drive piston. For clearing jams, a valve may be provided on the cylinder to exhaust the vacuum from the cylinder, or a cycle control may cause the drive mechanism to reengage the drive piston until the jam is cleared.

The fastener driving cycle of the apparatus disclosed herein may start with an electrical signal, after which a circuit connects a motor to the electrical power source. The motor is coupled to the drive piston through a drive mechanism that is capable of imparting a force on the drive piston to move the drive piston away from BDC and thereafter ceasing imparting a force on the drive piston to allow the drive piston to return to BDC for driving a fastener. Preferably, the drive mechanism is an interrupted drive mechanism such as an interrupted friction drive or comprising an interrupted gear. In an operational cycle of the drive mechanism, the mechanism alternatively (1) actuates the drive piston and (2) and decouples from the drive piston to allow other force(s) to act on the drive piston. For example, during a portion of its cycle, the interrupted drive mechanism may move the drive piston away from BDC such that a vacuum forms between the face of the drive piston and the bottom of the piston cylinder. In the next step of the cycle, the mechanism decouples from the drive piston to allow the vacuum to act on and actuate the drive piston. In an embodiment, the drive mechanism may retain the drive piston at a predetermined and/or constant distance away from BDC before allowing the vacuum to act on the drive piston. Further, at least one sensor may be disposed on the apparatus to determine a position of the friction or interrupted drive mechanism in order to facilitate stopping the drive mechanism in an approximately desired position. The drive piston thereupon moves back toward BDC to cause an anvil of or coupled to the drive piston assembly to drive a fastener, for example. A spring, elastomer, or other biasing element may be operatively coupled to the drive piston to maintain the drive piston at BDC until the drive mechanism acts on the drive piston. The aforementioned element may in addition provide additional energy to drive the fastener.

In an embodiment, the biasing element may be an elastomer disposed on or around the drive anvil of the piston, which may also assist with the creation/maintenance of a vacuum when the drive piston moves away from BDC. In an embodiment where the biasing element is a spring, the spring may be disposed between the top of the piston. In such an embodiment, an o-ring may seal the drive anvil to assist with the creation/maintenance of the vacuum. The biasing element also assists in minimizing the volume of air that is in the cylinder before the drive mechanism begins to cause the drive piston to move away from BDC, which reduces energy loss and improves the vacuum force created within the cylinder.

In an embodiment air space above the drive piston and a sealed end of the cylinder (on the side of the piston that is opposite to the portion of the cylinder in which the vacuum is generated) can provide an air chamber, which, as the drive piston moves from BDC becomes compressed beyond atmospheric pressure. In this embodiment, the force acting on the drive piston is increased as the differential pressure across the piston is a result of both the vacuum on the one side and the compressed air pressure on the other side. This increased pressure improves performance of the apparatus by allowing for higher energies than can be achieved by vacuum alone.

In an embodiment, a sensor and a control circuit are provided for determining at least one position of the drive piston to enable the proper timing for stopping the cycle or of the apparatus. An additional sensor or sensors can be used to determine if the drive piston and anvil has completed its downward stroke and be used to assist in error and or safe recovery in the event of a fastener jamb.

Accordingly, and in addition to the objects and advantages of the portable electric fastener gun as described above, several objects and advantages of the present invention are:

- To provide a simple design for driving fasteners that has a significantly lower production cost than currently available nail guns and that is portable and does not require an air compressor.
- To provide a fastener driving device that mimics the pneumatic fastener performance without a tethered air compressor.
- To provide an electrical driven high power fastening device that has very little wear.
- To provide an electric motor driven fastener driving device in which energy is not stored behind the fastener driving anvil, thus greatly enhancing tool safety.
- To provide a more energy efficient mechanism for driving nails than is presently achievable with a compressed air design.

These together with other aspects of the present disclosure, along with the various features of novelty that characterize the present disclosure, are pointed out with particularity in the claims annexed hereto and form a part of the present disclosure. For a better understanding of the present disclosure, its operating advantages, and the specific objects attained by its uses, reference should be made to the accompanying drawings and detailed description in which there are illustrated and described exemplary embodiments of the present disclosure.

DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE DISCLOSURE

Figure 1:
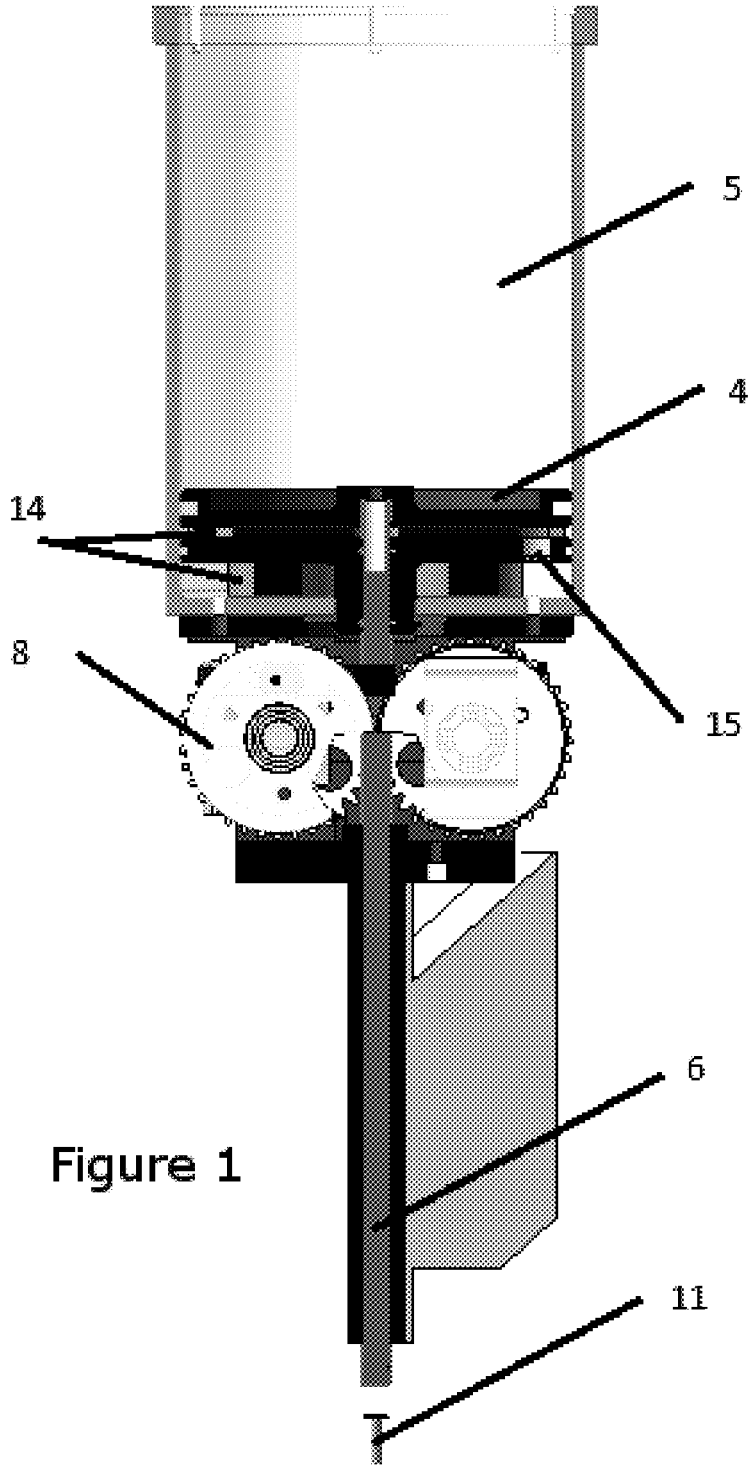
FIG. 1 shows a cutaway view of a fastener driving apparatus with a drive piston at BDC in accordance with an exemplary embodiment of the present disclosure.
Figure 2:
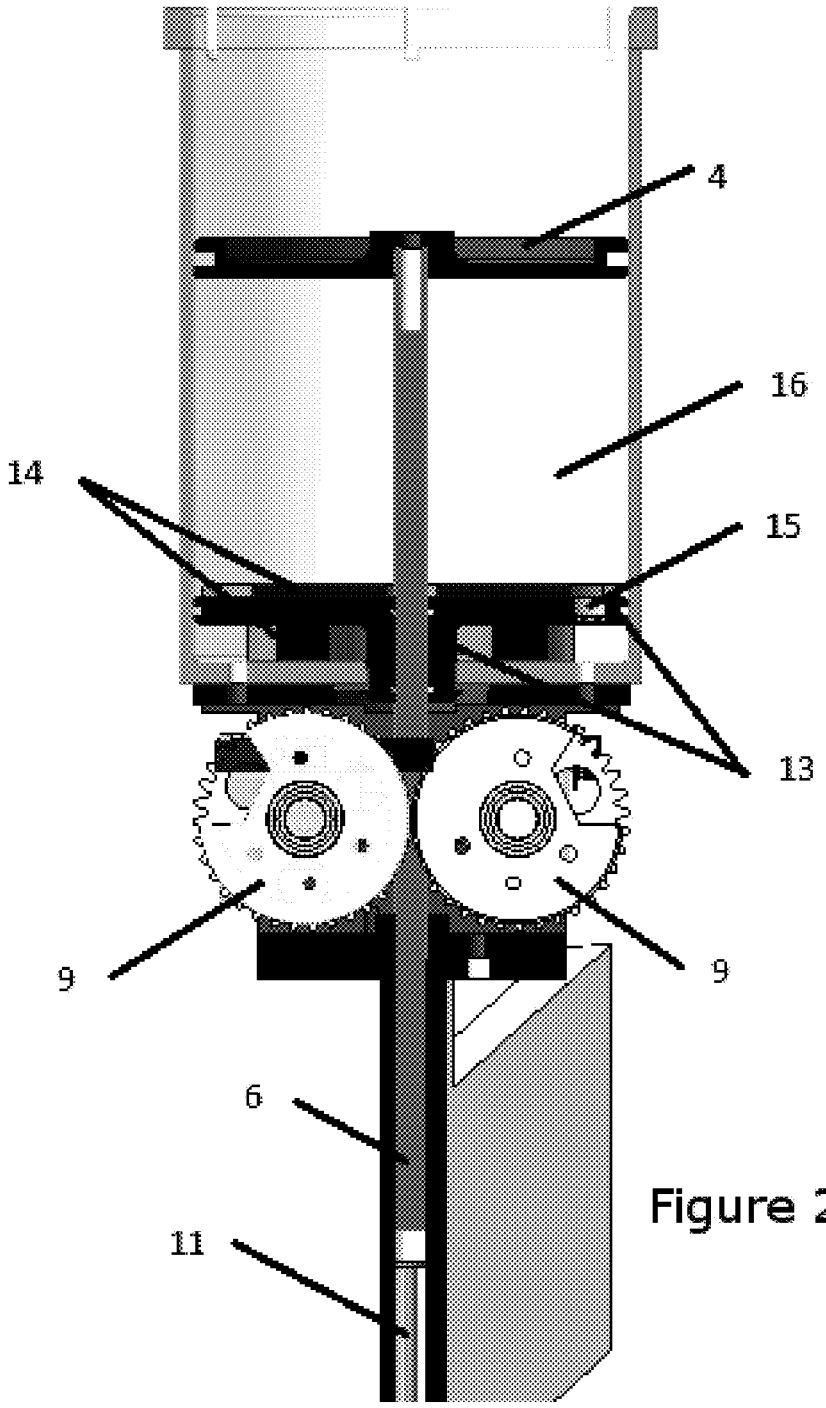
FIG. 2 shows a cutaway view of a fastener driving apparatus with a drive piston disposed away from BDC, in accordance with an exemplary embodiment of the present disclosure.

The best mode for carrying out the present disclosure is presented in terms of its preferred embodiment, herein depicted in the accompanying figures. The preferred embodiments described herein detail for illustrative purposes are subject to many variations. It is understood that various omissions and substitutions of equivalents are contemplated as circumstances may suggest or render expedient, but are intended to cover the application or implementation without departing from the spirit or scope of the present disclosure. Furthermore, although the following relates substantially to one embodiment of the design, it will be understood by those familiar with the art that changes to materials, part descriptions and geometries can be made without departing from the spirit of the invention. It is further understood that references such as front, back or top dead center, bottom dead center do not refer to exact positions but approximate positions as understood in the context of the geometry in the attached figures.

The terms "a" and "an" herein do not denote a limitation of quantity, but rather denote the presence of at least one of the referenced items.

The present disclosure provides for a fastener driving apparatus. In an embodiment, the apparatus comprises a power source (1), a control circuit, a motor (2), a drive mechanism (3), a drive piston (4) disposed with in a cylinder (5) and operatively coupled to the drive mechanism, and an anvil (6) coupled to the drive piston. (4) The apparatus also preferably comprises a biasing element (7) for temporarily holding the drive piston at BDC of the piston cylinder. The control circuit preferably includes a sensor (8).

The drive mechanism is capable of selectively applying force on the drive piston to move the drive piston away from BDC of the piston cylinder. The drive mechanism preferably comprises an interrupted drive mechanism, such as an interrupted gear mechanism, i.e., a rack pinion gear with intervals of teeth and no teeth. In a preferred embodiment, the drive mechanism comprises an interrupted friction wheel (9) which has both and engagement section and a non-engagement section. It will be apparent that the drive mechanism is configured to permit effectively instantaneous transition from when the drive mechanism is applying a force upon the drive piston to when the drive mechanism is not applying a force upon the drive piston. The drive mechanism is operatively coupled to the drive piston (4) (through an anvil, for example) such that the drive mechanism may alternate in actuating the piston (when the gear teeth are engaged, for example) and in withholding a drive force on the piston such that other forces (i.e., the vacuum) are able to act on and actuate the drive piston to allow the anvil coupled to the piston to drive a fastener.

In an embodiment, the drive mechanism engages and actuates the drive piston away from BDC of the cylinder thereby generating a vacuum (16) between the bottom of the cylinder and the bottom of the piston. The drive mechanism thereafter disengages the piston, allowing the vacuum (16) to act on the piston and cause the piston to return to BDC, causing the anvil (6) coupled to the piston (4) to drive a fastener (11) into a substrate. The interrupted drive mechanism may thereafter again act on the drive piston to again generate the vacuum within the cylinder and may thereafter again temporarily cease to act on the drive piston to allow the vacuum to instead act on the drive piston. In an embodiment, the ratio of maximum volume within the cylinder to the minimum vacuum volume within the cylinder is 3:1. It will be apparent that the cylinder will include a region of dead volume (namely, the region of the cylinder that is above the piston and opposite the region of the cylinder in which the vacuum is generated). In a preferred embodiment, the apparatus is configured such that the dead volume of the cylinder does not exceed 20% of the maximum vacuum volume of the cylinder. An unexpected result from this apparatus is that when the dead volume of the cylinder exceeded 10% of the maximum vacuum volume, the efficiency of the apparatus was substantially reduced.

The anvil is of the piston is preferably sealed to facilitate creation and maintenance of the vacuum. In an embodiment, an elastomer may be disposed about the anvil to act as the seal. The elastomer may also serve as the biasing element for holding the drive piston temporarily at BDC. In another embodiment, the biasing element may be a spring disposed between the top of the piston (4) and the top of the cylinder (12), and in this embodiment the anvil may be sealed with an o-ring.

In an embodiment, a floating seal (13) may be provided on or operatively coupled to the drive piston. A bumper (14) may be provided for absorbing at least a portion of the force of the anvil and/or drive piston after the anvil has driven a fastener. The floating seal allows for a reduction in the dead volume and the bumper facilitates dissipation of excess energy. Furthermore, a valve (15) can be predisposed within the vacuum area to allow for purging of any gas which leaks in during the vacuum stroke.

Figure 3:
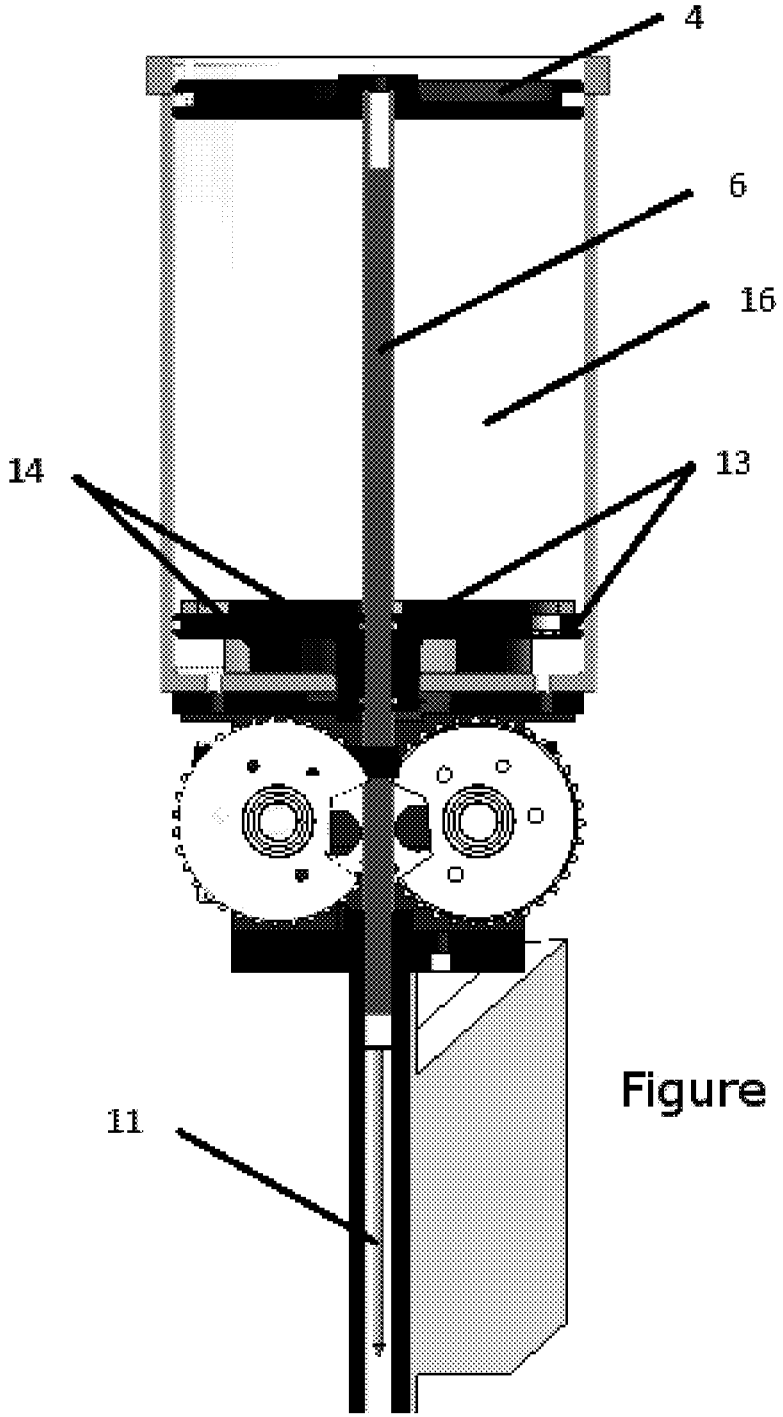
FIG. 3 shows a cutaway view of a fastener driving apparatus where the drive piston assembly is at the release point.
Figure 4:
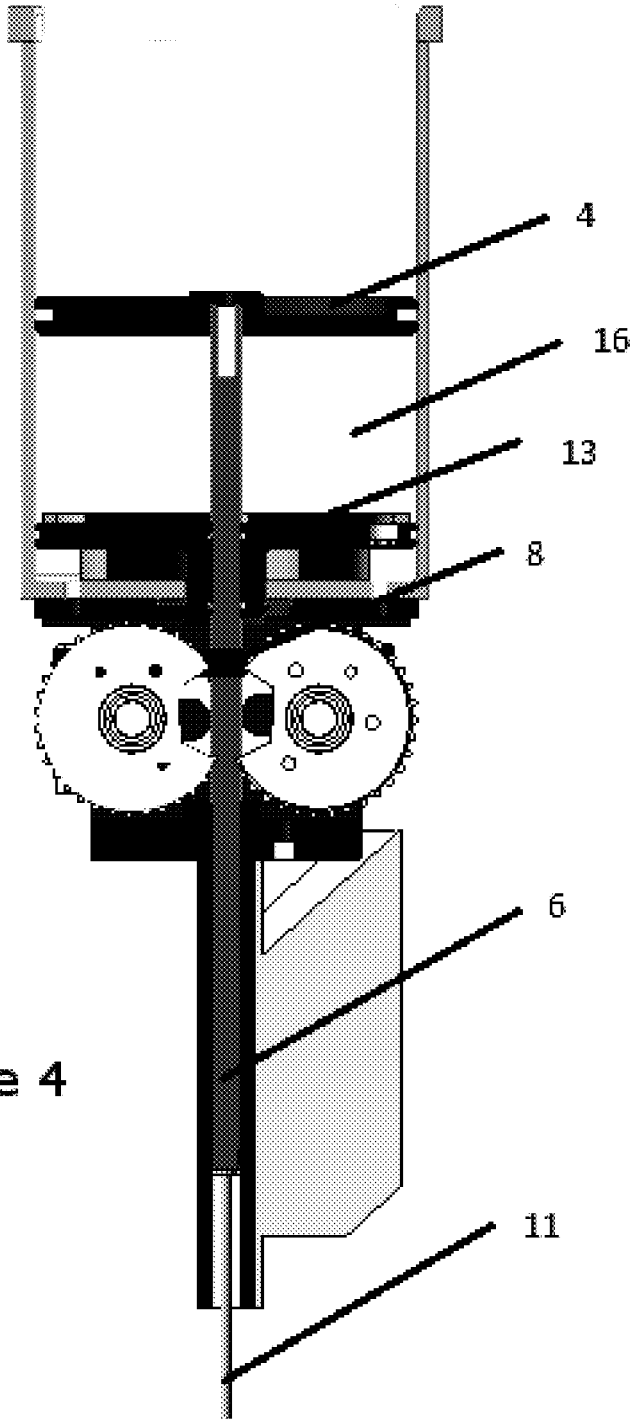
FIG. 4 shows a cutaway view of a fastener driving apparatus where the drive piston has been released and is driving a fastener into the substrate
Figure 5:
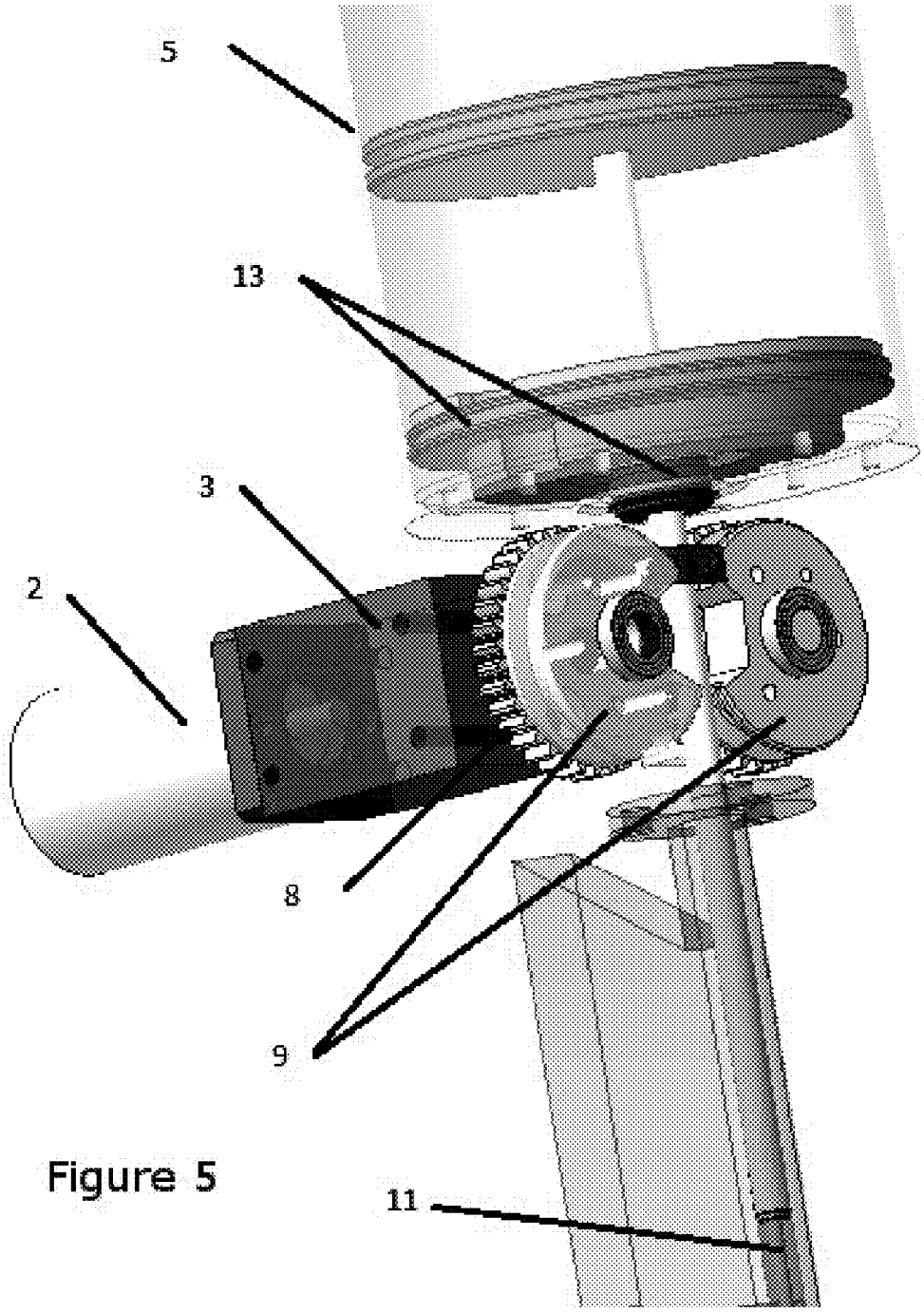
FIG. 5 shows a cutaway view of the bottom of the cylinder of a fastener driving apparatus, in accordance with an exemplary embodiment of the present disclosure illustrating a floating seal

In another embodiment, the drive mechanism may incorporate a clutch that prevents backdriving of the motor from the energy of the vacuum thus allowing safe use in clearing jams. The clutch further may allow the apparatus to pause at some point prior to the release of the drive piston assembly. The point of pause is preferably when at least 30% of the maximum vacuum has been created by movement of the drive piston. The pause after part of a cycle may be in response to a nail firing sequence known as bump fire in which the latency needs to be short (and preferably less than 100 milliseconds). The latency is the time between a user initiated event (such as depression of the nosepiece on the fastener driving apparatus) and the driving of the fastener The apparatus may also comprise a sensor (8) that is capable of detecting whether or not a fastener has been driven. As shown in FIGS. 3 and 4 for example, a sensor may be disposed on the anvil. If the sensor does not read within a certain prescribed time, the control circuit can instruct the motor or drive mechanism to lock the drive piston and or vent the vacuum. Such a vent can be a mechanical vent which is coupled to the drive mechanism and or an electrical vent. A preferred location of the vent could be in the floating seal (13) or in the wall of the cylinder. After the apparatus has been reset, the circuit will cause a recovery on a subsequent actuation of the apparatus by the user.

Figure 6:
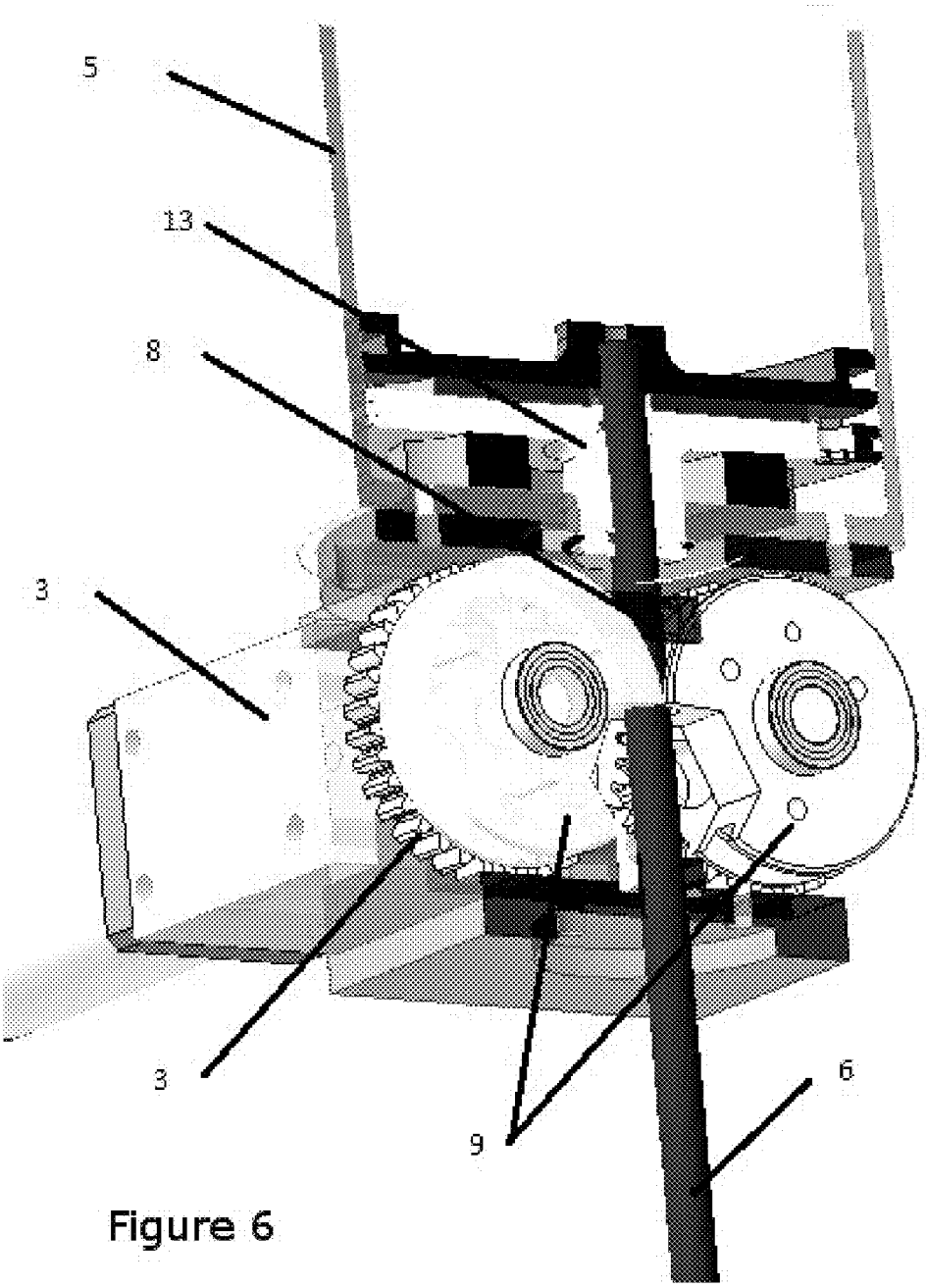
FIG. 6 shows a cutaway enlarged view of the drive mechanism in accordance with an exemplary embodiment of the present disclosure.
Figure 7:
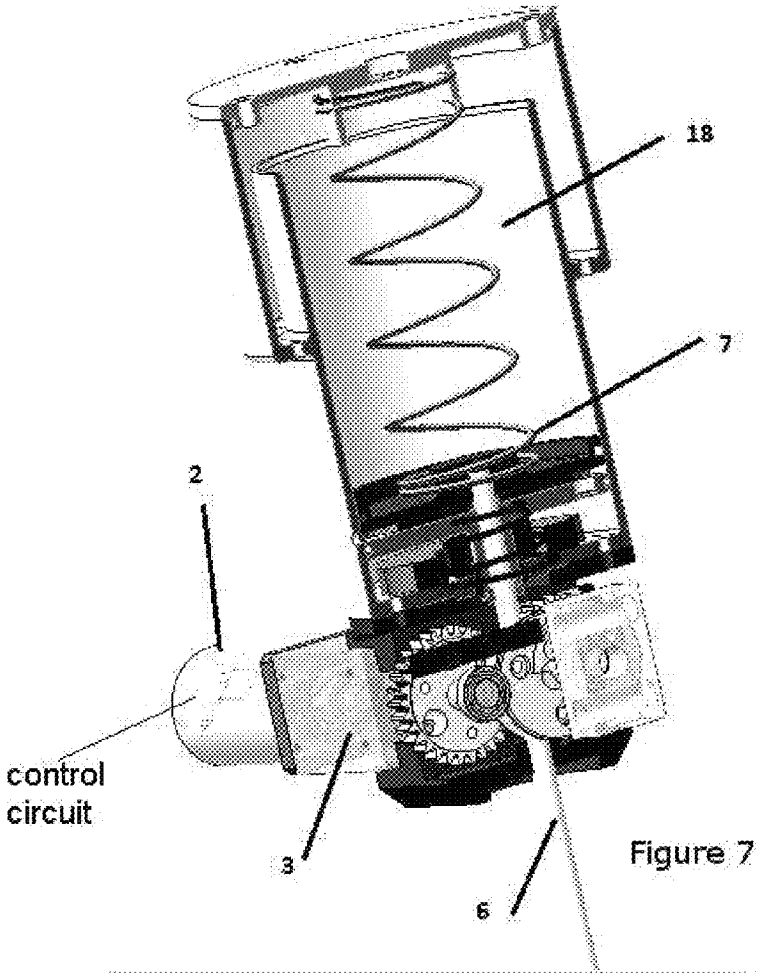
FIG. 7 shows a sealed air chamber of a cylinder of a fastener driving apparatus in accordance with an exemplary embodiment of the present disclosure.

The apparatus may also comprise pinch rollers for holding the anvil and for allowing movement of the anvil. A pinch roller may be spring loaded to clamp the anvil. In an exemplary operational cycle, when the interrupted part of the pinch roller comes adjacent to the anvil, it no longer is clamped and the springs no longer act on the anvil, thus allowing the anvil to be released and drive a fastener. In a single drive operation, the fastener is driven and the anvil and drive piston rest at the bottom of the cylinder or chamber until the operation sequence is called for again. The pinch rollers may be operatively coupled to the drive mechanism such that if a repeat drive operation sequence occurs, then the drive mechanism may act upon the pinch rollers as well as the drive piston. As shown in the figures, after the pinch roller has released the anvil and a fastener has been driven into the substrate, the apparatus is ready to initiate another cycle. This readiness may be signaled by way of a magnet (19) disposed in the drive piston anvil assembly. The pinch rollers preferably contact the drive anvil at an angle greater than 45 degrees as shown in FIG. 6. Using a taper fit of the pinch rollers to the anvil results in a higher force thus reducing slippage. Alternately, the materials of construction for the pinch roller (which is a variation of a friction wheel) are such that the coefficient of friction between the pinch rollers and the anvil is preferably at least 0.1, and more preferably at least 0.2

The apparatus may also comprise a substantially sealed air chamber on a side of the drive piston that is opposite the side of the drive piston that is proximate to the region of the cylinder in which the vacuum is generated. In an exemplary cycle, as the piston moves from BDC towards a top dead center (TDC) position, the air in said sealed air chamber (18) becomes compressed even while a vacuum is drawn underneath the drive piston. The combination of the compressed air and vacuum increases the force on the drive piston, which can result in a higher energy apparatus. For example, where the air chamber volume was is 100% of the total swept volume of the drive piston, the pressure across the drive piston will be more than twice that achieved by just the vacuum alone. In an embodiment, the ratio of the pressure (force) across the drive piston results in a drive piston acceleration of at least 500 square feet per second.

The present disclosure offers the following advantages: the assembly is capable of generating a relatively high amount of force in a small amount of space such that the size of the apparatus may be smaller than other fastener drivers. Further, because of the relatively limited number of components, cost and instances of component failure or wear and tear are reduced.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the disclosure and various embodiments with various modifications as are suited to the particular use contemplated.

What is claimed is:

1. A fastener driving apparatus, the apparatus comprising
a power source,
a control circuit,
a motor,
a cylinder,
a drive mechanism capable of selectively engaging and disengaging a drive piston, said drive piston disposed within said cylinder, said drive piston capable of moving to and from at least a top dead center position and a bottom dead center position in said cylinder, upon being engaged by said drive mechanism,
and an anvil, wherein said anvil is operatively coupled to said drive piston,
wherein said drive mechanism selectively engages said drive piston to apply a force on said drive piston to move said drive piston within said cylinder and thereafter disengages from and ceases applying a force on said drive piston,
wherein when said drive mechanism engages said drive piston to move said drive piston away from said bottom dead center position of said cylinder, a vacuum is generated in the cylinder, which vacuum, after said drive mechanism thereafter disengages said drive piston, acts on said drive piston to cause the said piston to move toward said bottom dead center position of said cylinder, said anvil driving a fastener upon said movement of said drive piston.

2. The fastener driving apparatus of claim 1, wherein said apparatus further comprises one of a mechanical spring and an elastomer disposed about said anvil, which spring or elastomer biases said drive piston at said bottom dead center position within said cylinder.

3. The fastener driving apparatus of claim 1, in which the dead volume of said cylinder does not exceed 20% of the maximum vacuum volume of said cylinder.

4. The fastener driving apparatus of claim 1, wherein said control circuit further comprises at least one sensor, wherein said at least one sensor may determine at least one of the position of said drive piston, the position of said drive mechanism, whether said apparatus has driven a fastener, and a fault condition in said apparatus.

5. The fastener driving apparatus of claim 1, wherein said drive mechanism comprises one of an interrupted friction wheel and a rack-and-pinion arrangement, and wherein said interrupted friction wheel has a coefficient of friction of at least 0.1.

6. The fastener driving apparatus of claim 1, wherein said drive mechanism further comprises a clutch for holding said drive piston in a position away from bottom dead center before one of ceasing to impart a force on said drive piston and said vacuum acts on said drive piston, and wherein said clutch allows for latency of less than 100 milliseconds upon a user-initiated event.

7. The fastener driving apparatus of claim 1, wherein said drive piston further comprises a floating seal, which floating seal is disposed between said drive piston and said bottom dead center of said cylinder,
wherein when said drive piston moves away from said bottom dead center position of said cylinder, a vacuum is generated between said floating seal and said drive piston, and
said floating seal has a stroke that is no more than 50% of the stroke of said drive piston.

8. The fastener driving apparatus of claim 7, wherein said apparatus further comprises at least one bumper disposed adjacent said floating seal.

9. The fastener driving apparatus of claim 1, wherein the ratio of the force across said drive piston results in a drive piston acceleration of at least 500 feet per second squared.

10. The fastener driving apparatus of claim 1, wherein the ratio of the maximum vacuum volume to the minimum vacuum volume is at least 3:1.

11. The fastener driving apparatus, wherein said apparatus further comprises a valve operatively coupled to a portion of said cylinder in which a vacuum is formed.

12. The fastener driving apparatus of claim 1, further comprising a sealed air chamber on the side of the drive piston opposite the region of the cylinder in which the vacuum is generated.

13. A fastener driving apparatus, the apparatus comprising
a power source,
a control circuit,
a motor,
a cylinder,
a drive mechanism capable of selectively engaging and disengaging a drive piston, said drive piston disposed within said cylinder, said drive piston capable of moving to and from at least a top dead center position and a bottom dead center position in said cylinder, upon being engaged by said drive mechanism, an anvil, wherein said anvil is operatively coupled to said drive piston, and a sealed air chamber on the side of the drive piston opposite the region of the cylinder in which the vacuum is generated.

wherein said drive mechanism comprises an engagement region for engaging and causing said drive piston to move within said cylinder and a non-engagement region for ceasing to cause said drive mechanism to cease causing said drive piston to so move, wherein when said drive mechanism engages said drive piston to move said drive piston away from said bottom dead center position of said cylinder, a vacuum is generated in a region of the cylinder and air is compressed in the sealed air chamber, which vacuum and compressed air, after said drive mechanism thereafter disengages said drive piston, act on said drive piston to cause the said piston to move toward said bottom dead center position of said cylinder, said anvil driving a fastener upon said movement of said drive piston.

14. The fastener driving apparatus of claim 13, wherein said apparatus further comprises one of a mechanical spring and an elastomer disposed about said anvil, which spring or elastomer biases said drive piston at said bottom dead center position within said cylinder.

15. The fastener driving apparatus of claim 13, in which the dead volume of said cylinder does not exceed 20% of the maximum vacuum volume of said cylinder.

16. The fastener driving apparatus of claim 13, wherein said drive mechanism further comprises a clutch for holding said drive piston in a position away from bottom dead center before one of ceasing to impart a force on said drive piston and said vacuum acts on said drive piston, and wherein said clutch allows for latency of less than 100 milliseconds upon a user-initiated event.

17. The fastener driving apparatus of claim 13, wherein said drive piston further comprises a floating seal, which floating seal is disposed between said drive piston and said bottom dead center of said cylinder, wherein when said drive piston moves away from said bottom dead center position of said cylinder, a vacuum is generated between said floating seal and said drive piston, and said floating seal has a stroke that is no more than 50% of the stroke of said drive piston.

18. The fastener driving apparatus of claim 13, wherein the ratio of the force across said drive piston results in a drive piston acceleration of at least 500 feet per second squared.

19. The fastener driving apparatus of claim 13, wherein the ratio of the maximum vacuum volume to the minimum vacuum volume is at least 3:1.

20. The fastener driving apparatus of claim 13, wherein said drive mechanism comprises one of an interrupted friction wheel and a rack-and-pinion arrangement, and wherein said interrupted friction wheel has a coefficient of friction of at least 0.1.

* * * * *